US008250767B1

(12) United States Patent
Ciccarella et al.

(10) Patent No.: US 8,250,767 B1
(45) Date of Patent: Aug. 28, 2012

(54) TILE KNIFE APPARATUS

(76) Inventors: Paul Ciccarella, Melbourne (AU); Robert Ciccarella, Melbourne (AU); Adrian Pariselli, Melbourne (AU)

( * ) Notice: Subject to any disclaimer, the term of this patent is extended or adjusted under 35 U.S.C. 154(b) by 375 days.

(21) Appl. No.: 12/398,428

(22) Filed: Mar. 5, 2009

(51) Int. Cl.
*B26B 3/08* (2006.01)

(52) U.S. Cl. ..... 30/314; 30/353

(58) Field of Classification Search ..... 30/314, 30/315, 317, 353; D22/118; D8/98
See application file for complete search history.

(56) References Cited

U.S. PATENT DOCUMENTS

| | | | | | |
|---|---|---|---|---|---|
| 334,724 | A | | 1/1886 | Ruekstuhl | |
| 1,843,223 | A | | 5/1930 | Hasseler | |
| D128,623 | S | | 3/1941 | Dorcas | |
| 2,635,337 | A | * | 4/1953 | Mercy | 30/353 |
| 3,241,236 | A | * | 3/1966 | Capps | 30/287 |
| 3,918,158 | A | | 11/1975 | Debski | |
| 4,283,854 | A | * | 8/1981 | Austin | 30/314 |
| D268,001 | S | | 2/1983 | Balz | |
| 4,662,070 | A | | 5/1987 | Reddig | |
| D337,247 | S | | 7/1993 | Dart | |
| D380,520 | S | * | 7/1997 | Hibben | D22/118 |
| 5,720,105 | A | | 2/1998 | Gates | |
| D398,211 | S | * | 9/1998 | Howard | D8/98 |
| D409,270 | S | * | 5/1999 | Balolia | D22/118 |
| 6,658,743 | B2 | * | 12/2003 | Dudley et al. | 30/314 |

* cited by examiner

*Primary Examiner* — Hwei C Payer

(57) ABSTRACT

The tile knife apparatus provides a specialized blade particularly useful in tile work, coupled with an ergonomic handle which provides maximum leverage with a comfortable grip and natural alignment with the blade. The apparatus is especially suited to tile spacer removal and adhesive removal. The blades are provided in varied embodiment widths, including 1 millimeter, 3 millimeters, and 5 millimeters. The blade has a flat edge so that prying and scraping are best facilitated, without excessive injury risk to hands or tile. Each feature of the handle works in coordination with the blade features to facilitate natural hand alignment with work to be performed, while ensuring against hand fatigue. The handle enables easy grip and provides gradually coordinated surfaces and rounded convex ends to avoid user fatigue and hand injuries such as blisters and undue callusing. The ergonomic handle provides for ambidextrous use.

20 Claims, 4 Drawing Sheets

FIG. 1
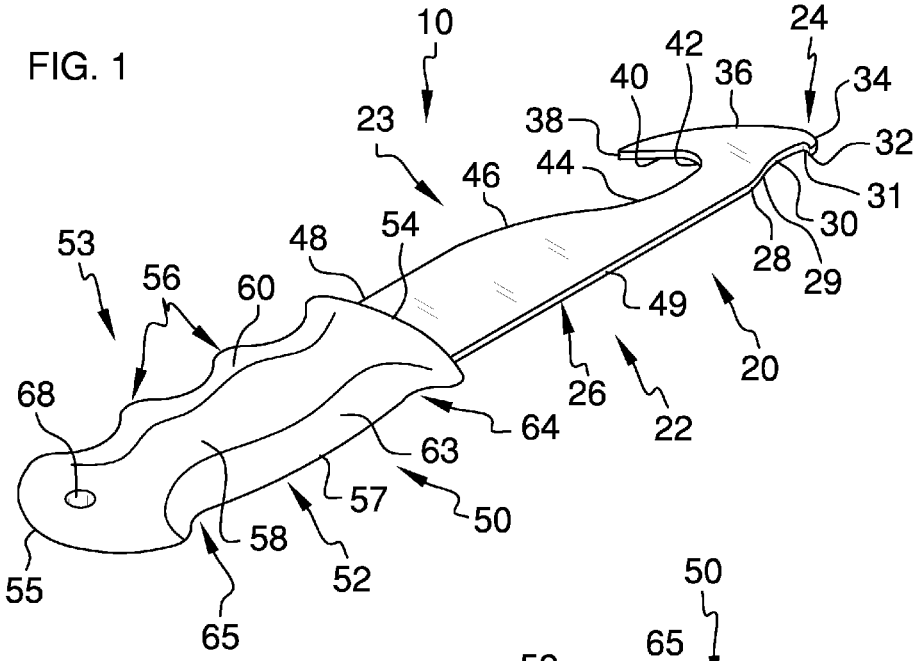
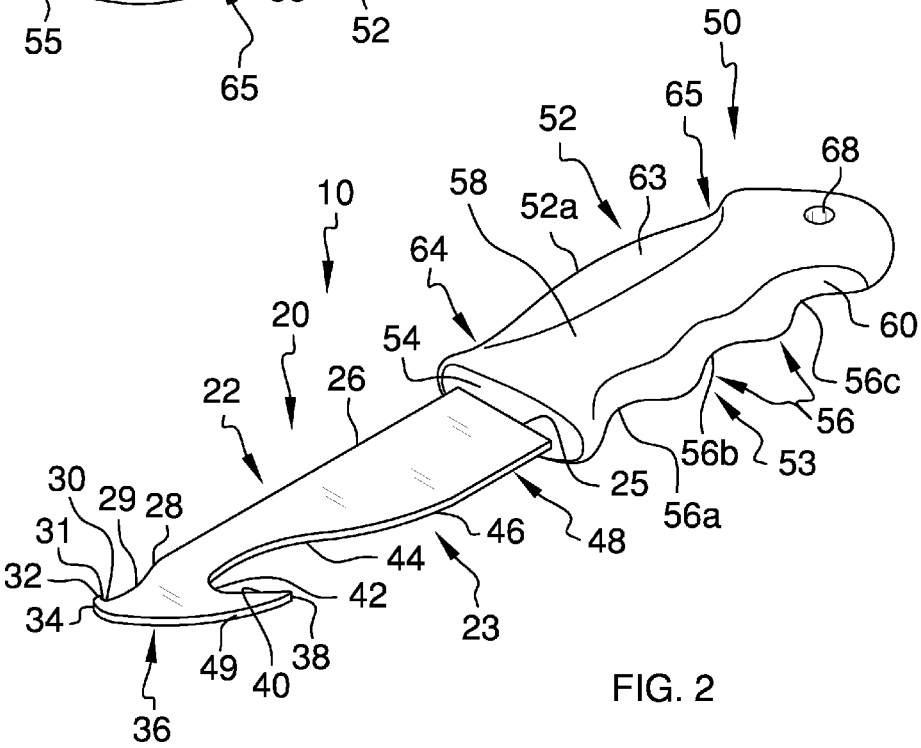
FIG. 2

TILE KNIFE APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various utility knives have been provided in the past. Knives especially suited to working with tiles and also floorings are typically very specialized, if they are to be efficiently and successfully used. A tile worker, especially a skilled one, quickly realizes the advantages provided by even one feature of many that such a specialized knife can provide, saving time, effort, and guarding against injury to the user and to surrounding materials and surfaces, including surfaces worked with. While the present knife apparatus provides features that can be utilized in many pursuits, the apparatus is particularly useful in working with tile.

FIELD OF THE INVENTION

The present apparatus relates to utility knives and more especially to a utility knife that provides particularly useful features for working with tile.

SUMMARY OF THE INVENTION

The general purpose of the tile knife apparatus, described subsequently in greater detail, is to provide a tile knife apparatus which has many novel features that result in an improved tile knife apparatus which is not anticipated, rendered obvious, suggested, or even implied by prior art, either alone or in combination thereof.

To attain this, the tile knife apparatus provides a specialized blade particularly useful in tile work, coupled with an ergonomic handle which provides maximum leverage with a comfortable grip and natural alignment with the blade. While the knife can be used for a variety of tasks outside of tile work, the blade and handle features to be outlined are particularly suited for tile work tasks, and even more especially to tile spacer removal and adhesive removal. The blades are provides in varied embodiment widths, including 1 millimeter, 3 millimeters, and 5 millimeters. The plurality of blade width offerings provides for removing different spacer widths from between tiles. Additionally, the blade has a flat edge so that prying and scraping are best facilitated, without excessive injury risk as is known in the art when sharp blades have been a forced alternative prior to the present apparatus. Each feature of the handle works in coordination with the blade features to facilitate natural hand alignment with work to be performed, without undue risk of injury to a user's hand.

Further, the handle not only enables easy grip but also provides gradually coordinated surfaces and rounded convex ends to avoid user fatigue and minor hand injuries such as blisters and undue callusing, problems often associated with poor tool handle design. The blade features enable instant access to the desired tasks, without undue consideration otherwise needed to avoid injury to hands or work items and surfaces. The ergonomic handle provides for ambidextrous use. Each feature of the apparatus saves considerable time in performing tasks otherwise time intensive.

Thus has been broadly outlined the more important features of the improved tile knife apparatus so that the detailed description thereof that follows may be better understood and in order that the present contribution to the art may be better appreciated.

An object of the tile knife apparatus is to be especially useful in tile work.

Another object of the tile knife apparatus is to provide multiple features for tile work that have not heretofore been provided.

A further object of the tile knife apparatus is to be particularly useful in removing excess adhesive from tile.

An added object of the tile knife apparatus is to be particularly useful in removing tile spacers.

Further, an object of the tile knife apparatus is to provide for working with different spacings and tile spacers between tiles.

Still another object of the tile knife apparatus is to provide flat blade sides.

And, an object of the tile knife apparatus is to provide an especially beneficial ergonomic grip.

Yet another object of the tile knife apparatus is to avoid injury to hands and to work surfaces.

These together with additional objects, features and advantages of the improved tile knife apparatus will be readily apparent to those of ordinary skill in the art upon reading the following detailed description of presently preferred, but nonetheless illustrative, embodiments of the improved tile knife apparatus when taken in conjunction with the accompanying drawings.

In this respect, before explaining the current embodiments of the improved tile knife apparatus in detail, it is to be understood that the tile knife apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved tile knife apparatus. It is therefore important that the claims be regarded as including such equivalent constructions insofar as they do not depart from the spirit and scope of the tile knife apparatus. It is also to be understood that the phraseology and terminology employed herein are for purposes of description and should not be regarded as limiting.

BRIEF DESCRIPTION OF THE DRAWINGS

FIG. 1 is a perspective view with handle in foreground.

FIG. 2 is a perspective view with blade in foreground.

DETAILED DESCRIPTION OF THE DRAWINGS

Figure 3:
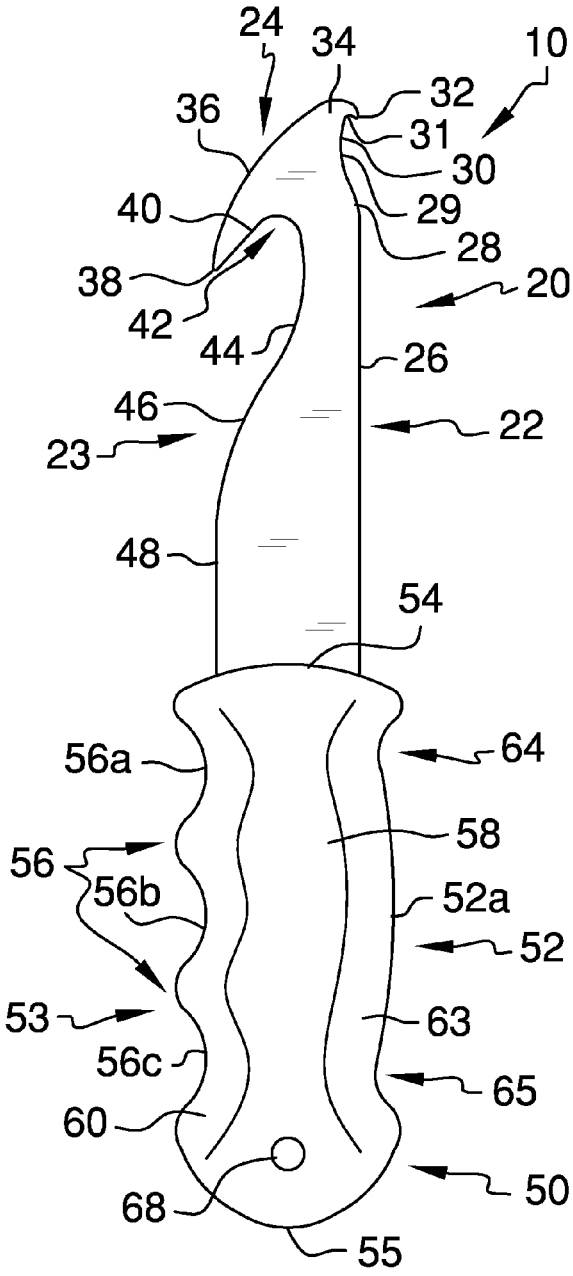
FIG. 3 is a left side perspective view.
Figure 4:
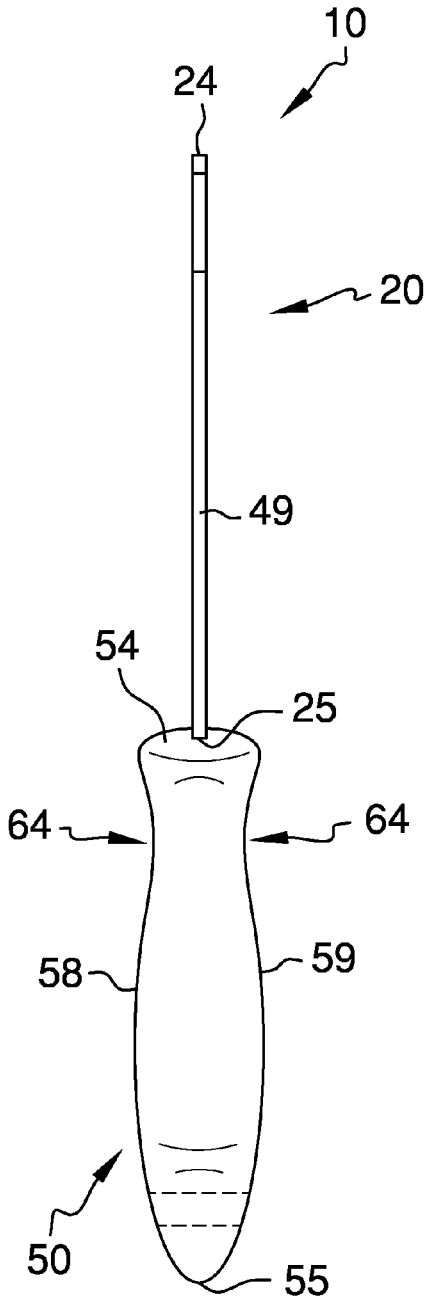
FIG. 4 is a first side perspective view.

With reference now to the drawings, and in particular FIGS. 1 through 6 thereof, the principles and concepts of the tile knife apparatus generally designated by the reference number 10 will be described.

Referring to FIGS. 1-4, the tile knife apparatus 10 comprises the flat blade 20 having a first end 24 spaced apart from a second end 25 and a first side 22 spaced apart from a second side 23. The ergonomic handle 50 has a handle first side 52 spaced apart from a handle second side 53. The handle 50 further comprises the convex first end 54 spaced apart from the rounded convex second end 55. The convex first end 54 is affixed to the blade 20 second end 25. The blade 20 further comprises a blade first side flat 26 that extends from the handle 50 convex first end 54 along a substantial length of the blade 20.

The blade 20 inward bend 28 extends from the first side flat 26. The reverse bend 29 extends from the inward bend 28. The short flat 30 extends from the reverse bend 29. The right angle section 31 is perpendicularly extended from the reverse bend 29. The right angle tip 32 ends the right angle section 31. The right angle tip 32 is laterally even with the first side flat 26. The sharp bend 34 extends from the right angle tip 32. The gradual bend 36 extends from the sharp bend 34 and ends on the blade 20 second side 23. The reverse tip 38 ends the gradual bend 36. The reverse flat section 40 extends inwardly from the reverse tip 38. The sharp transition bend 42 extends from the reverse flat section 40. The outward bend 44 extends from the sharp transition bend 42. The second side gradual bend 46 extends from the outward bend 44. The second side flat 48 extends from the second side gradual bend 46 to the handle 50 convex first end 54. The second side flat 48 is laterally even with the reverse tip 38. A flat edge 49 is disposed around the entire blade 20. The ergonomic handle 50 further comprises the handle first side 52 in alignment with the blade 20 first side 22. The handle second side 53 is in alignment with the blade 20 second side 23. The gradual convex section 52*a* is disposed along a substantial portion of the handle first side 52. The finger grip 56 is disposed along a substantial portion of the handle second side 53. The finger grip 56 comprises a first detent 56*a* spaced apart from a second detent 56*b* spaced apart from a third detent 56*c*. The first constriction 64 is disposed between the convex first end 54 and the gradual convex section 52*a*. The first constriction 64 extends around the handle 50 to meet the first detent 56*a*.

The second constriction 65 is disposed between the convex second end 55 and the gradual convex section 52*a* on the handle first side 52. The rounded left body 58 is spaced apart from the rounded right body 59. The rounded left body 58 extends from the first constriction 64 to the convex second end 55. The rounded right body 59 is opposite the rounded left body 58. The rounded right body 59 extends from the first constriction 64 to the convex second end 55. The left side grip taper 60 is laterally adjacent to the rounded left body 58. The left side grip taper 60 ends in the finger grip 56. The right side grip taper (not shown) is laterally adjacent to the rounded right body 59. The right side grip taper ends in the finger grip 56. The right side grip taper is a mirror image of the left side grip taper 60. The handle first side left taper 63 is laterally adjacent to the rounded left body 58. The handle first side left taper 63 ends in the handle first side 52. The handle first side right taper is laterally adjacent to the rounded right body 59. The handle first side right taper ends in the handle first side 52. An orifice 68 is disposed in the rounded convex second end 55. The orifice 68 is disposed through both rounded bodies to enable hanging of the apparatus 10 from various hooks, nails, and the like, or even having a tie cord affixed through the orifice 68 for convenience in carrying and storage.

Figure 5:
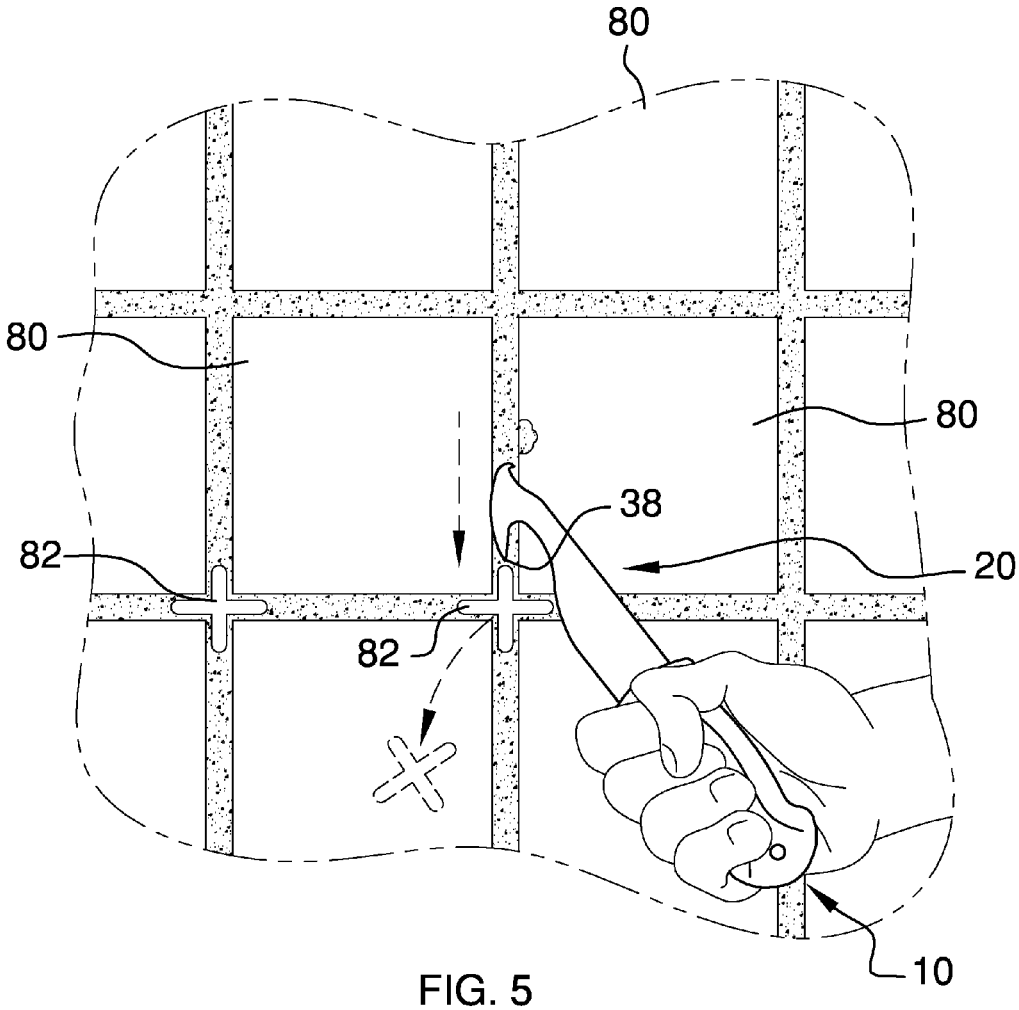
FIG. 5 is a perspective view of the apparatus removing a tile spacer.
Figure 6:
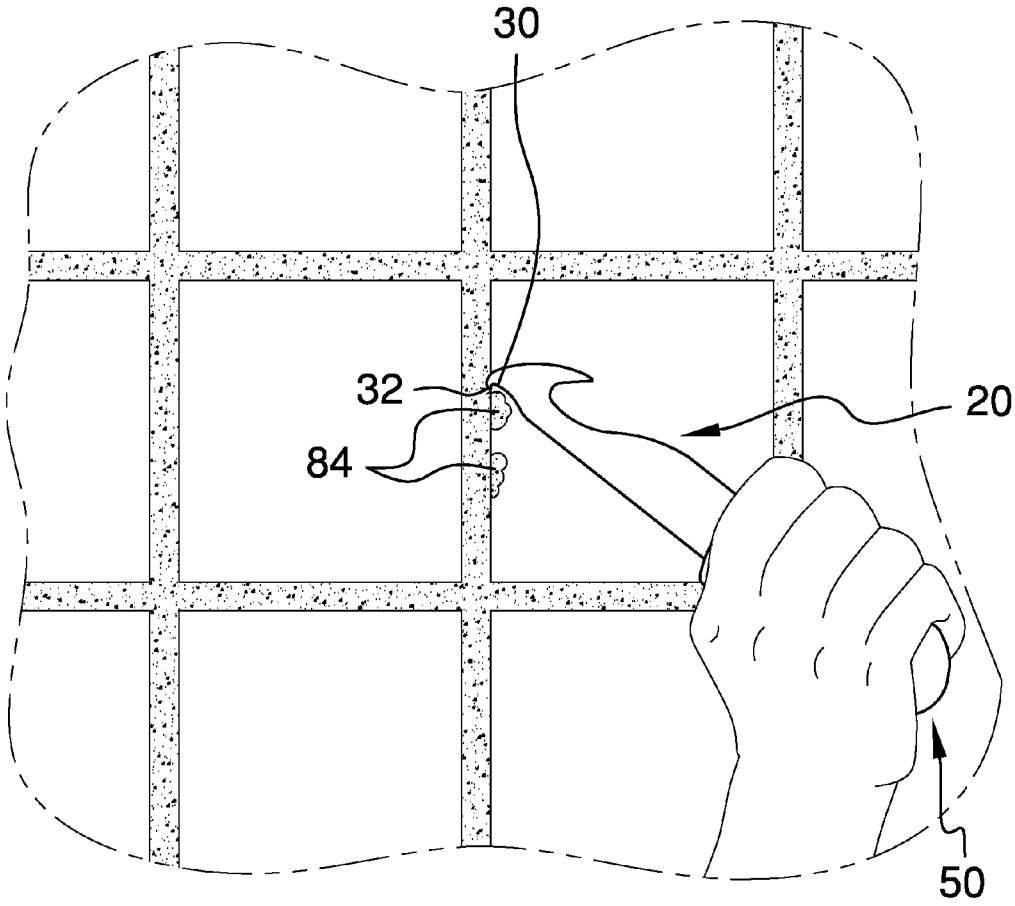
FIG. 6 is a perspective view of the apparatus removing excess adhesive.

Referring to FIG. 5, the apparatus 10 is used to remove the tile spacer 82 from between tiles 80. The importance of the ergonomic handle 50 and the blade 20 cannot be overstated. The relationship between the handle 50 and blade 20 determine the usefulness of the apparatus 10, as does each feature of the blade 20. The reverse tip 38 and related bends and flats enable the blade 20 reverse tip 38 to hook the tile spacer 82 for easy removal, without undue time and effort expended, a fact especially appreciated by a worker needing to remove numerous spacers 82.

Referring to FIG. 6 and again to FIG. 3, the ergonomic handle 50 further enables the user to utilize the right angle tip 32, the short flat 30, and the right angle section 31 to remove excess adhesive 84 from the face of the tile 80. The flat edge 49 is especially useful in adhesive removal while preventing user injury. Each feature of the blade is especially important in the user's natural alignment with work to be performed, without undue conscious effort or hand injury.

With respect to the above description then, it is to be realized that the optimum dimensional relationships for the parts of the tile knife apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the tile knife apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the tile knife apparatus may be used.

Therefore, the foregoing is considered as illustrative only of the principles of the tile knife apparatus. Further, since numerous modifications and changes will readily occur to those skilled in the art, it is not desired to limit the tile knife apparatus to the exact construction and operation shown and described, and accordingly, all suitable modifications and equivalents may be resorted to, falling within the scope of the tile knife apparatus.

What is claimed is:

1. A tile knife apparatus comprising:

a flat blade having a first end spaced apart from a second end, a first side spaced apart from a second side;

an ergonomic handle having a handle first side spaced apart from a handle second side, a handle first end spaced apart from a handle second end, the handle first end affixed to the blade second end, the blade further comprising:

a blade first side flat, the first side flat extended from the handle first end along a substantial length of the blade;

an inward bend extended from the first side flat;

a reverse bend extended from the inward bend;

a short flat extended from the reverse bend;

a right angle section perpendicularly extended from the reverse bend;

a right angle tip ending the right angle section;

a sharp bend extended from the right angle tip;

a gradual bend extended from the sharp bend and ending on the blade second side;

a reverse tip ending the gradual bend;

a reverse flat section extended inwardly from the reverse tip;

a sharp transition bend extended from the reverse flat section;

an outward bend extended from the sharp transition bend;

a second side gradual bend extended from the outward bend;

a second side flat extended from the second side gradual bend to the handle first end;

the handle first side in alignment with the blade first side, the handle second side in alignment with the blade second side;

a gradual convex section disposed along a substantial portion of the handle first side;

a finger grip disposed along a substantial portion of the handle second side, the finger grip comprising a first detent spaced apart from a second detent spaced apart from a third detent, the finger grip disposed between the handle first end and the handle second end;

a first constriction disposed between the handle first end and the gradual convex section, the first constriction extended around the handle to the first detent;

a second constriction disposed between the handle second end and the gradual convex section on the handle first side;

a rounded left body spaced apart from a rounded right body, the rounded left body extended from the first constriction to the handle second end, the rounded left body extended from the gradual convex section to the finger grip, the rounded right body opposite the rounded left body; the rounded right body extended from the first constriction to the handle second end, the rounded right body extended from the gradual convex section to the finger grip;

an orifice disposed in the rounded handle second end, the orifice through both rounded bodies.

2. The apparatus according to claim 1 wherein the blade has a thickness of about 1 millimeter.

3. The apparatus according to claim 1 wherein the blade has a thickness of about 3 millimeters.

4. The apparatus according to claim 1 wherein the blade has a thickness of about 5 millimeters.

5. The apparatus according to claim 1 wherein the handle first end is convex.

6. The apparatus according to claim 2 wherein the handle first end is convex.

7. The apparatus according to claim 3 wherein the handle first end is convex.

8. The apparatus according to claim 4 wherein the handle first end is convex.

9. The apparatus according to claim 5 wherein the handle second end is rounded convex.

10. The apparatus according to claim 6 wherein the handle second end is rounded convex.

11. The apparatus according to claim 7 wherein the handle second end is rounded convex.

12. The apparatus according to claim 8 wherein the handle second end is rounded convex.

13. A tile knife apparatus, comprising:

a flat blade having a first end spaced apart from a second end, a first side spaced apart from a second side;

an ergonomic handle having a handle first side spaced apart from a handle second side, a convex first end spaced apart from a rounded convex second end, the convex first end affixed to the blade second end, the blade further comprising:

a blade first side flat, the first side flat extended from the handle convex first end along a substantial length of the blade;

an inward bend extended from the first side flat;

a reverse bend extended from the inward bend;

a short flat extended from the reverse bend;

a right angle section perpendicularly extended from the reverse bend;

a right angle tip ending the right angle section;

a sharp bend extended from the right angle tip;

a gradual bend extended from the sharp bend and ending on the blade second side;

a reverse tip ending the gradual bend;

a reverse flat section extended inwardly from the reverse tip;

a sharp transition bend extended from the reverse flat section;

an outward bend extended from the sharp transition bend;

a second side gradual bend extended from the outward bend;

a second side flat extended from the second side gradual bend to the handle convex first end;

the ergonomic handle further comprising:

the handle first side in alignment with the blade first side, the handle second side in alignment with the blade second side;

a gradual convex section disposed along a substantial portion of the handle first side;

a finger grip disposed along a substantial portion of the handle second side, the finger grip comprising a first detent spaced apart from a second detent spaced apart from a third detent, the finger grip disposed between the handle first end and the handle second end;

a first constriction disposed between the convex first end and the gradual convex section, the first constriction extended around the handle to the first detent;

a second constriction disposed between the convex second end and the gradual convex section on the handle first side;

a rounded left body spaced apart from a rounded right body, the rounded left body extended from the first constriction to the convex second end, the rounded right body opposite the rounded left body; the rounded right body extended from the first constriction to the convex second end;

a left side grip taper laterally adjacent to the rounded left body, the left side grip taper ending in the finger grip;

a right side grip taper laterally adjacent to the rounded right body, the right side grip taper ending in the finger grip;

a handle first side left taper laterally adjacent to the rounded left body, the handle first side left taper ending in the handle first side;

a handle first side right taper laterally adjacent to the rounded right body, the handle first side right taper ending in the handle first side;

an orifice disposed in the rounded convex second end, the orifice through both rounded bodies.

14. The apparatus according to claim 13 wherein the blade has a thickness of about 1 millimeter.

15. The apparatus according to claim 13 wherein the blade has a thickness of about 3 millimeters.

16. The apparatus according to claim 13 wherein the blade has a thickness of about 5 millimeters.

17. A tile knife apparatus, comprising:

a flat blade having a first end spaced apart from a second end, a first side spaced apart from a second side;

an ergonomic handle having a handle first side spaced apart from a handle second side, a convex first end spaced apart from a rounded convex second end, the convex first end affixed to the blade second end, the blade further comprising:

a blade first side flat, the first side flat extended from the handle convex first end along a substantial length of the blade;

an inward bend extended from the first side flat;

a reverse bend extended from the inward bend;

a short flat extended from the reverse bend;

a right angle section perpendicularly extended from the reverse bend;

a right angle tip ending the right angle section, the right angle tip laterally even with the first side flat;

a sharp bend extended from the right angle tip;

a gradual bend extended from the sharp bend and ending on the blade second side;

a reverse tip ending the gradual bend;

a reverse flat section extended inwardly from the reverse tip;

a sharp transition bend extended from the reverse flat section;

an outward bend extended from the sharp transition bend;

a second side gradual bend extended from the outward bend;

a second side flat extended from the second side gradual bend to the handle convex first end, the second side flat laterally even with the reverse tip;

a flat edge disposed around the entire blade;

the ergonomic handle further comprising:

the handle first side in alignment with the blade first side, the handle second side in alignment with the blade second side;

a gradual convex section disposed along a substantial portion of the handle first side;

a finger grip disposed along a substantial portion of the handle second side, the finger grip comprising a first detent spaced apart from a second detent spaced apart from a third detent;

a first constriction disposed between the convex first end and the gradual convex section, the first constriction extended around the handle to meet the first detent;

a second constriction disposed between the convex second end and the gradual convex section on the handle first side;

a rounded left body spaced apart from a rounded right body, the rounded left body extended from the first constriction to the convex second end, the rounded right body opposite the rounded left body; the rounded right body extended from the first constriction to the convex second end;

a left side grip taper laterally adjacent to the rounded left body, the left side grip taper ending in the finger grip;

a right side grip taper laterally adjacent to the rounded right body, the right side grip taper ending in the finger grip;

a handle first side left taper laterally adjacent to the rounded left body, the handle first side left taper ending in the handle first side;

a handle first side right taper laterally adjacent to the rounded right body, the handle first side right taper ending in the handle first side;

an orifice disposed in the rounded convex second end, the orifice through both rounded bodies.

18. The apparatus according to claim 17 wherein the blade has a thickness of about 1 millimeter.

19. The apparatus according to claim 17 wherein the blade has a thickness of about 3 millimeters.

20. The apparatus according to claim 17 wherein the blade has a thickness of about 5 millimeters.

* * * * *